US008900076B1

(12) United States Patent
Shropshire

(10) Patent No.: US 8,900,076 B1
(45) Date of Patent: Dec. 2, 2014

(54) QUARTERBACK TRAINING APPARATUS

(71) Applicant: Darian Shropshire, Baton Rouge, LA (US)

(72) Inventor: Darian Shropshire, Baton Rouge, LA (US)

( * ) Notice: Subject to any disclaimer, the term of this patent is extended or adjusted under 35 U.S.C. 154(b) by 36 days.

(21) Appl. No.: 13/785,162

(22) Filed: Mar. 5, 2013

(51) Int. Cl.
*A63B 69/00* (2006.01)

(52) U.S. Cl.
CPC ..... *A63B 69/002* (2013.01)
USPC ..... 473/439; 273/400

(58) Field of Classification Search
USPC ..... 273/398–402, 406, 407, 350, 366–370; 473/195, 196, 438, 439
See application file for complete search history.

(56) References Cited

U.S. PATENT DOCUMENTS

| | | | | | |
|---|---|---|---|---|---|
| 1,419,554 | A * | 6/1922 | Ganse | 273/400 |
| 2,586,958 | A * | 2/1952 | Keller | 273/406 |
| 3,398,954 | A * | 8/1968 | Nedwick | 473/438 |
| 3,467,380 | A * | 9/1969 | Bonacci | 473/439 |
| 3,680,862 | A * | 8/1972 | Russell et al. | 473/439 |
| 3,810,618 | A * | 5/1974 | Nedwick | 473/439 |
| 3,823,939 | A * | 7/1974 | Bottorff | 473/439 |
| 4,079,939 | A * | 3/1978 | Raistakka | 273/402 |
| 4,150,823 | A * | 4/1979 | Boganowski | 273/317.5 |
| 4,202,547 | A * | 5/1980 | Mueller | 473/161 |
| 4,700,952 | A * | 10/1987 | Patsy | 473/446 |
| 4,826,166 | A * | 5/1989 | Baker et al. | 473/439 |
| 4,936,578 | A * | 6/1990 | Hudson, Sr. | 473/439 |
| 5,016,890 | A * | 5/1991 | Sato et al. | 463/52 |
| 5,037,095 | A * | 8/1991 | Nedwick | 473/439 |
| 5,252,076 | A * | 10/1993 | Kelleher | 473/438 |
| 5,688,196 | A * | 11/1997 | O'Neil | 473/439 |
| 5,746,669 | A * | 5/1998 | Sinsheimer et al. | 473/446 |
| 5,868,396 | A * | 2/1999 | Theissen | 273/406 |
| 6,736,738 | B1 * | 5/2004 | Taa | 473/439 |
| 7,011,310 | B2 * | 3/2006 | Rowan | 273/398 |
| 7,090,596 | B2 * | 8/2006 | David | 473/439 |
| 7,134,976 | B1 * | 11/2006 | Smith | 473/446 |
| 7,288,033 | B1 * | 10/2007 | Jordan | 473/439 |
| 7,708,003 | B1 * | 5/2010 | Gavieres | 124/78 |
| 7,850,551 | B2 * | 12/2010 | Barber | 473/439 |
| 2005/0192126 | A1 * | 9/2005 | Remaklus | 473/447 |
| 2007/0099730 | A1 * | 5/2007 | Driver | 473/422 |
| 2010/0298074 | A1 * | 11/2010 | Esposito | 473/438 |
| 2013/0040764 | A1 * | 2/2013 | Daniels | 473/439 |

* cited by examiner

*Primary Examiner* — Mark Graham
(74) *Attorney, Agent, or Firm* — Kyle A. Fletcher, Esq.

(57) ABSTRACT

The quarterback training apparatus is comprised of an array of tracks that extend laterally, diagonally, or longitudinally, and which accommodates at least one movable target thereon. Each movable target includes a track-engaging member from which a pivoting member extends vertically therefrom, and atop of which is a basket. Each basket includes a flexible net that extends from a back opening in order to collect a football that is thrown therein. The baskets may have varying diameters, and may be tilted to a multitude of orientations via the pivoting member. The track-engaging member enables the basket to be moved along the respective track while the pivoting member enables the basket to be adjusted at varying orientations. When fully constructed, an end user is able to throw a plurality of footballs at the various targets in order to practice different types of football throws.

16 Claims, 6 Drawing Sheets

QUARTERBACK TRAINING APPARATUS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of football practice equipment, more specifically, a quarterback training apparatus.

B. Discussion of the Prior Art

As will be discussed immediately below, no prior art discloses an array of tracks that extend laterally, diagonally, or longitudinally, and which accommodates at least one movable target thereon; wherein each movable target includes a track-engaging member from which a pivoting member extends vertically therefrom, and atop of which is a basket; wherein each basket includes a flexible net that extends from a back opening in order to collect a football that is thrown therein; wherein the baskets have varying diameters; wherein the baskets include an opening along a flat bottom at which the flexible net extends therefrom; wherein the track-engaging member enables the basket to be moved along the respective track while the pivoting member enables the basket to be adjusted at varying orientations; wherein an end user is able to threw a plurality of footballs at the various targets in order to practice different types of football throws.

The Hudson, Sr. Patent (U.S. Pat. No. 4,936,578) discloses a quarterback practice target that is comprised of multiple hoops. However, the practice target includes a plurality of loops that are secured to a vertical pole, and which are not configured for use with a plurality of tracks to provide for movement thereon.

The Bottorff et al. Patent (U.S. Pat. No. 3,823,939) discloses an apparatus for practicing football passing that includes a carriage mounted on an inside track consisting of a vertically positioned hoop with a net. However, the apparatus is adapted to provide movement of the hoop and net along a track as opposed to a series of movable targets that are stationary when conducting a passing drill, and which are moved between passing drills.

The Haddix Patent Application Publication (U.S. Pub. No. 2006/0148599) discloses a sports training target for training an individual in throwing of a ball of projectile. However, the target is mounted atop of a wheeled cart, which includes a handle for manipulation with respect to the ground.

The Nedwick Patent (U.S. Pat. No. 5,037,095) discloses a quarterback trainer game apparatus that comprises a flexible back panel suspended from a frame member that is suspended from a support structure. However, the apparatus does not include a plurality of tracks upon which the movable targets slide.

The McLain Patent (U.S. Pat. No. 5,516,115) discloses a portable ball practice target that includes a framework that supports a net. However, the target does not move.

The Britton at al. Patent Application Publication (U.S. Pub. No. 2010/0140873) discloses a portable gaming apparatus in which a projectile is thrown by an end user at one of a numerous targets. However, the gaming apparatus does not include movable targets that move and pivot with respect to an array of tracks.

The Russell et al. Patent (U.S. Pat. No. 3,680,862) discloses a multiple target for use in playing a football game. Again, the target is unable to slide on tracks that are mounted to a ground, and which provide for pivoting of targets.

The O'Neil Patent (U.S. Pat. No. 5,688,196) discloses a portable, remote moving target for passing practice. However, the target is in motion during a passing drill, and does not work in conjunction with a multitude of targets that are moved along tracks.

The Miller, Jr. Patent (U.S. Pat. No. Des. 344,765) illustrates an ornamental design for a football target, which is unable to move along a track.

While the above-described devices fulfill their respective and particular objects and requirements, they do not describe an array of tracks that extend laterally, diagonally, or longitudinally, and which accommodates at least one movable target thereon; wherein each movable target includes a track-engaging member from which a pivoting member extends vertically therefrom, and atop of which is a basket; wherein each basket includes a flexible net that extends from a back opening in order to collect a football that is thrown therein; wherein the baskets have varying diameters; wherein the baskets include an opening along a flat bottom at which the flexible net extends therefrom; wherein the track-engaging member enables the basket to be moved along the respective track while the pivoting member enables the basket to be adjusted at varying orientations; wherein an end user is able to throw a plurality of footballs at the various targets in order to practice different types of football throws. In this regard, the quarterback training apparatus departs from the conventional concepts and designs of the prior art.

SUMMARY OF THE INVENTION

The quarterback training apparatus is comprised of an array of tracks that extend laterally, diagonally, or longitudinally, and which accommodates at least one movable target thereon. Each movable target includes a track-engaging member from which a pivoting member extends vertically therefrom, and atop of which is a basket. Each basket includes a flexible net that extends from a back opening in order to collect a football that is thrown therein. The baskets may have varying diameters, and nay be tilted to a multitude of orientations via the pivoting member. The track-engaging member enables the basket to be moved along the respective track while the pivoting member enables the basket to be adjusted at varying orientations. When fully constructed, an end user is able to throw a plurality of footballs at the various targets in order to practice different types of football throws.

It is an object of the invention to provide a football throwing apparatus that is ideally suited for practice with a quarterback, and which involves a multitude of movable targets that may be moved along different tracks.

A further object of the invention is to provide a pivoting member that enables the movable targets to be pivoted about a pivot point, and which enables the orientation of the basket to be adjusted.

An even further object of the invention is to provide a pivoting member that is able to rotate 360 degrees along a vertical axis with respect to the track via the track-engaging member.

A further object of the invention is to provide a track-engaging member that enables the movable target to move along the track.

An even further object of the invention is to provide a basket that has an opening at the back portion, and from which flexible net extends there from to enable footballs to be collected therein.

An even further object of the invention is to provide an array of tracks that extend laterally, longitudinally, or diagonally.

These together with additional objects, features and advantages of the quarterback training apparatus will be readily apparent to those of ordinary skill in the art upon reading the following detailed description of presently preferred, but nonetheless illustrative, embodiments of the quarterback training apparatus when taken in conjunction with the accompanying drawings.

In this respect, before explaining the current embodiments of the quarterback training apparatus in detail, it is to be understood that the quarterback training apparatus is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the quarterback training apparatus.

It is therefore important that the claims be regarded as including such equivalent construction insofar as they do not depart from the spirit and scope of the quarterback training apparatus. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
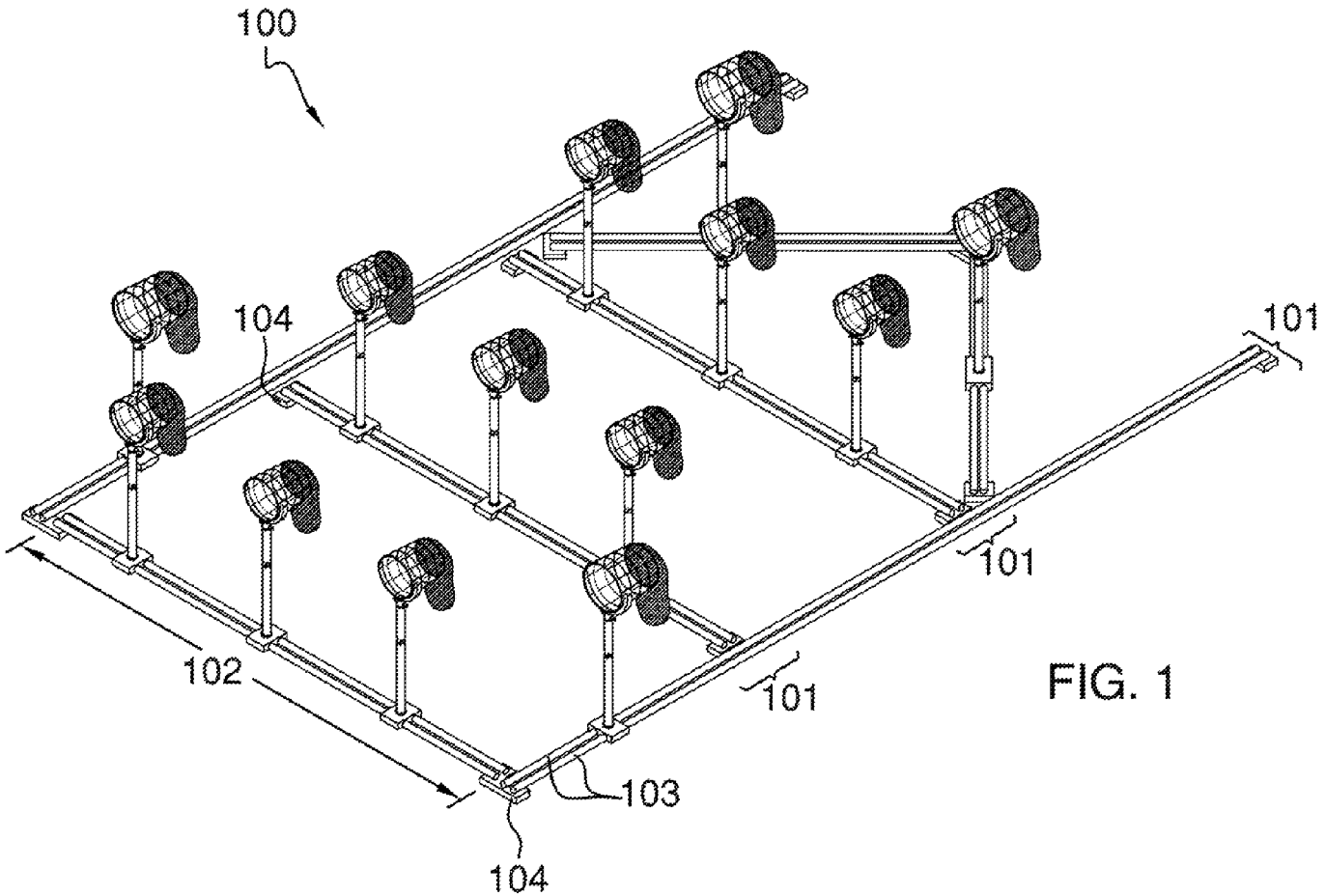
FIG. 1 illustrates a perspective view of the quarterback training apparatus by itself, and with a plurality of movable targets provided on the array of tracks.
Figure 2:
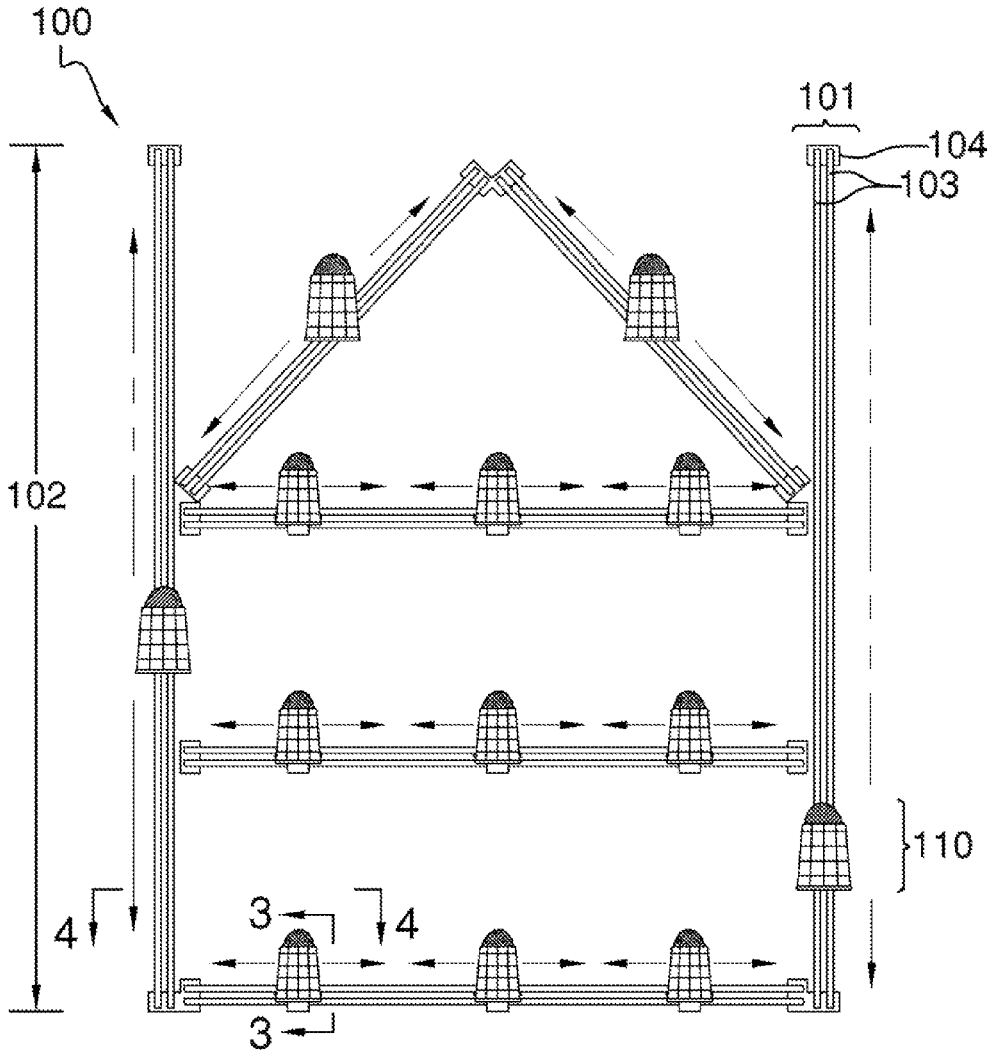
FIG. 2 illustrates a top view of the quarterback training apparatus wherein arrows indicate translational movement of the movable targets on the respective tracks.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A quarterback training apparatus 100 (hereinafter invention) includes a plurality of tracks 101 that are of undefined lengths 102, and are oriented in multiple arrangements comprising of lateral, longitudinal, or diagonal orientations (see FIGS. 1-2). The tracks 102 form an array, and are each comprised of a pair of tubular members 103, which include a track support 104 at distal ends.

The invention 100 includes a plurality of movable targets 110, which are individually engaged upon the tracks 101, and which are able to move back and forth along the length 102 of the tracks 101. The movable targets 110 each include a track-engaging member 111 that connects to and slides on the tubular members 103 of the track 101.

The track-engaging member 111 includes a receptacle 112 from which a pivoting member 113 extends vertically therefrom. The pivoting member 113 extends vertically, and supports a basket 114 atop thereof. The pivoting member 113 is able to rotate 360 degrees with respect to the receptacle 112 of the track-engaging member 111.

The basket 114 is unique to the invention 100 in that each basket 114 has a rear opening 115 at which a flexible net 116 is affixed thereto. The basket 114 may be of wire constructed, and is secured to a "U"-shaped member 117 that is mounted atop of the pivoting member 113.

The flexible net 116 is included in order for a football 150 to be thrown through the basket 114, and fall down into the flexible net 116. The flexible net 116 is of an undefined length 127, and may be able to collect and support a plurality of footballs 150 that have been consecutively collected when using the invention 100 during a passing drill. Moreover, the baskets 114 have a front opening 119 that is the essence of the movable target 110, and with which the objective is to throw the football 150 into the front opening 119 where the football 150 will come to rest in the flexible net 116. It shall be noted that the baskets 114 are each further defined with a basket diameter 118, and that the basket diameter 118 may vary amongst the severable movable targets 110.

The "U"-shaped member 117 secures the baskets 114 at opposing sides, and provides for a more comprehensive means of support for the basket 114 with respect to the pivoting member 113. The pivoting member 113 is further defined with a first pivot member 121 and a second pivot member 122 that are connected to one another at a pivot point 123.

Figure 3:
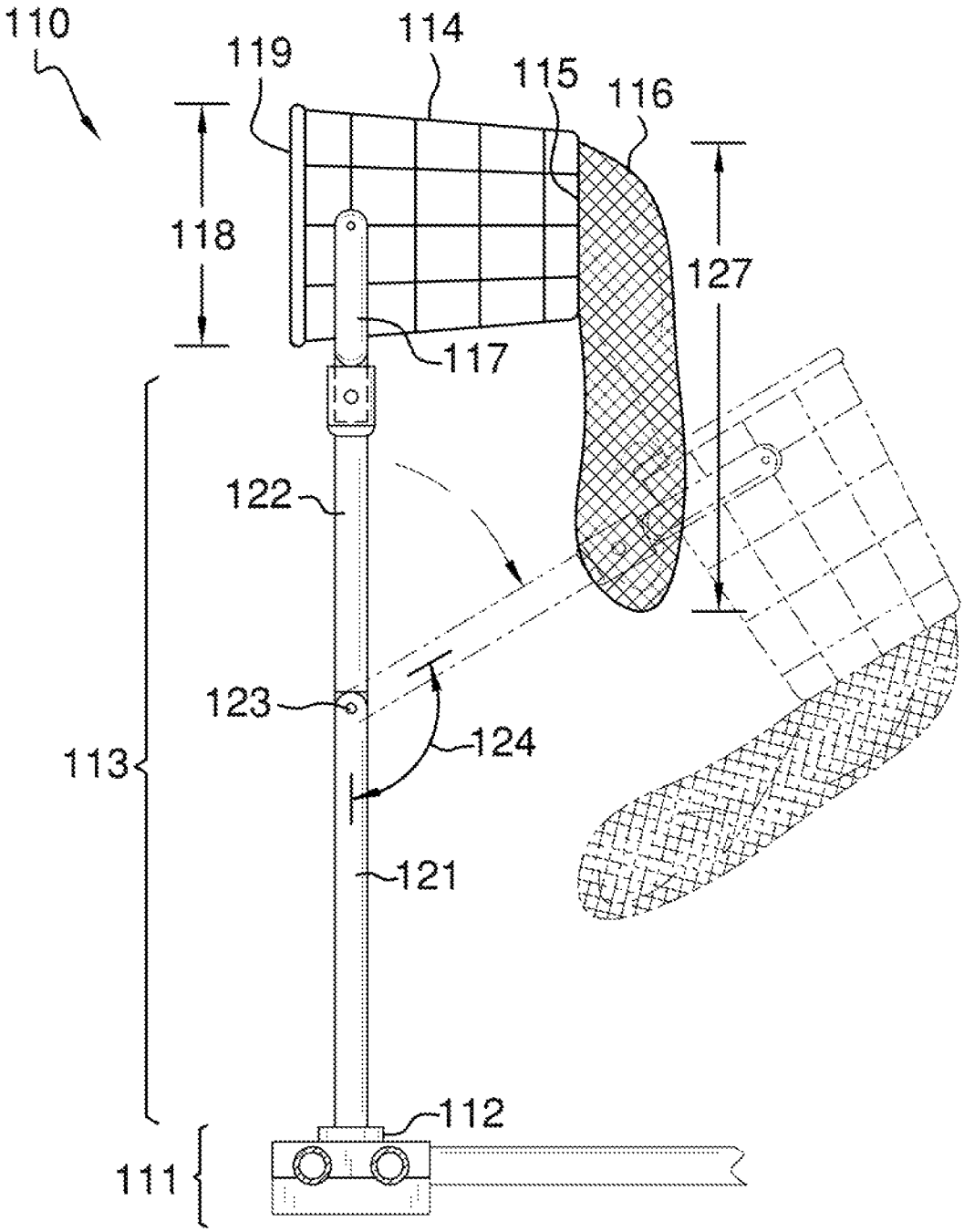
FIG. 3 illustrates a cross-sectional view along line 3-3 in FIG. 2, and depicting one of the movable targets wherein detail is provided as to the rotation of the pivoting member.
Figure 5:
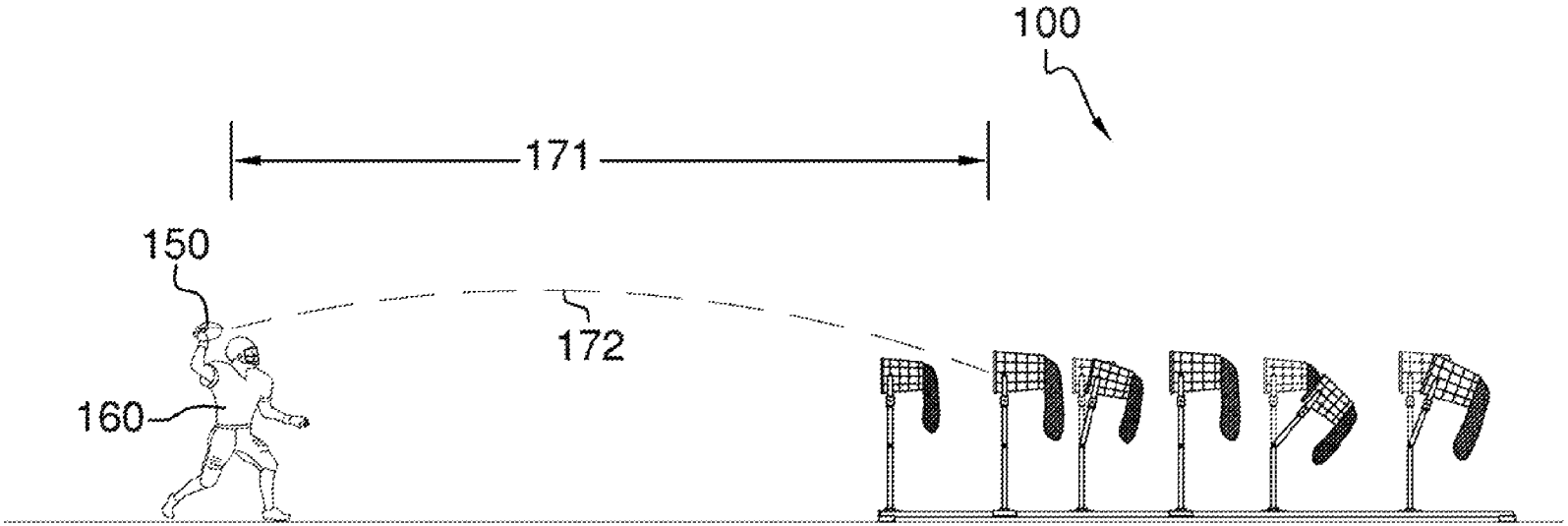
FIG. 5 illustrates a view of the quarterback training apparatus in use.

A pivot angle 124 may be selectively adjusted at the pivot point 123, which in turn adjusts the orientation of the basket 114 with respect to the ground. Referring to FIGS. 3 and 5, the baskets 114 can be set at different orientations such that when conducting a throwing drill, an end user 160 must attempt different types of passes. More specifically, the different types of passes may involve different pass lengths 171 and/or different pass trajectories 172.

Figure 3A:
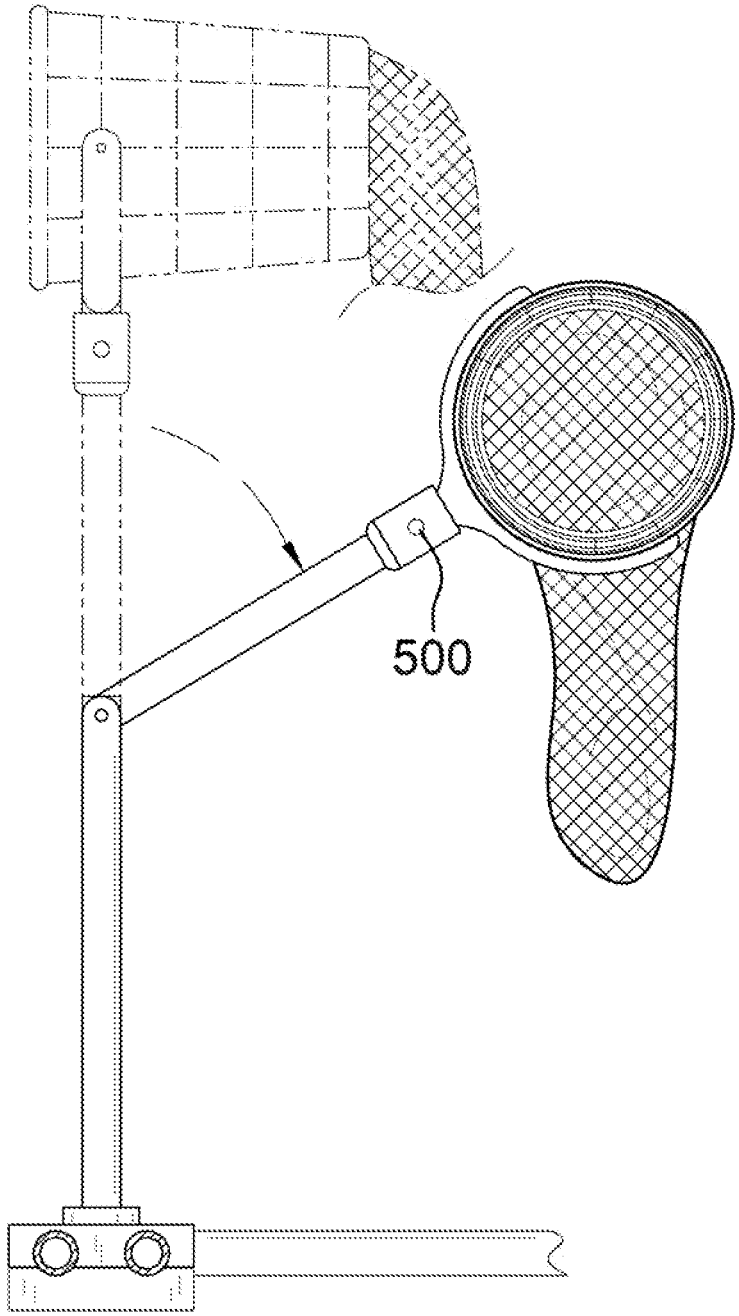
FIG. 3A illustrates another cross-sectional view that depicts the pivoting of the "U"-shaped member with respect to the second pivoting member.
Figure 4:
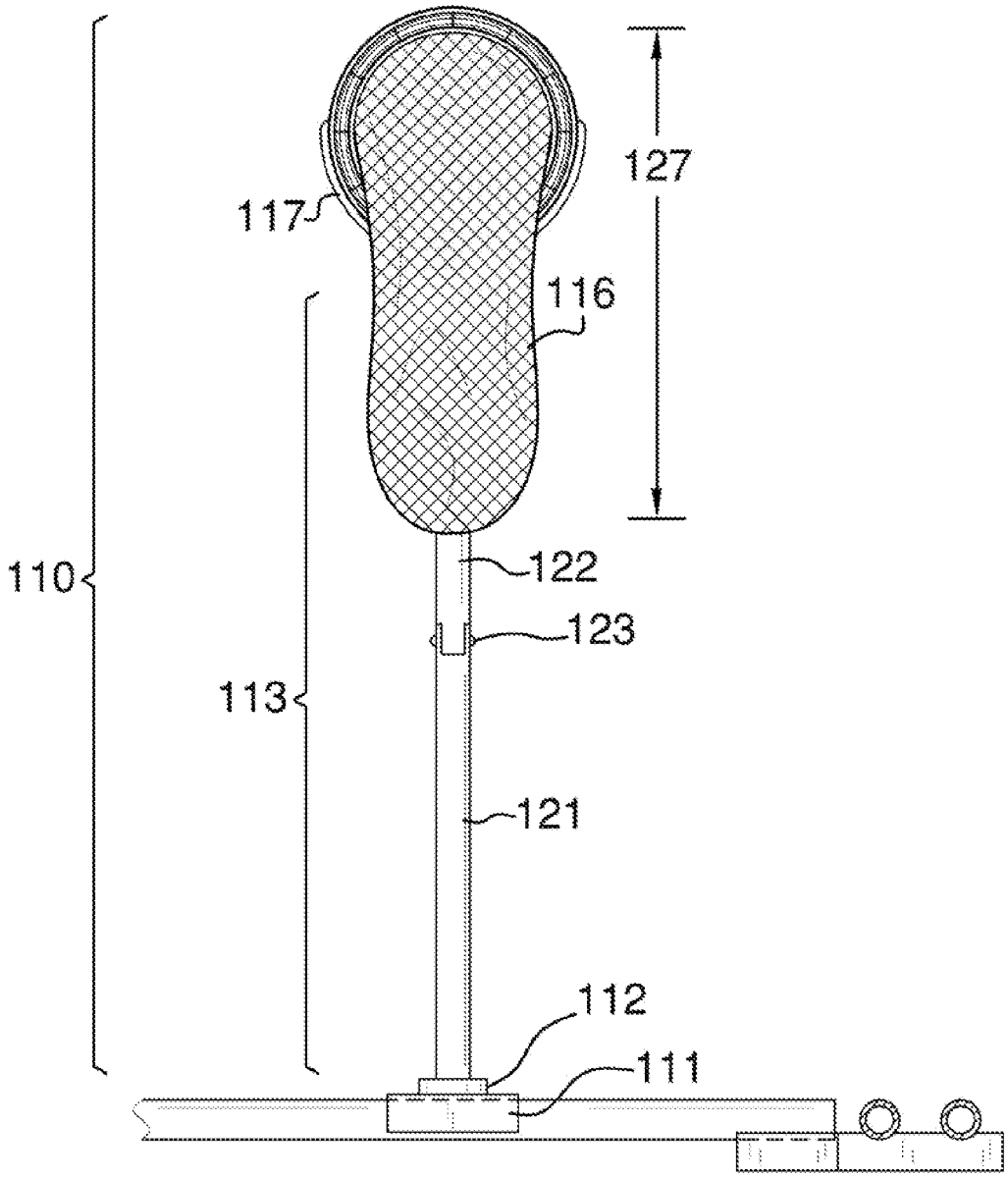
FIG. 4 illustrates a cross-sectional view along line 4-4 in FIG. 2, and depicting one of the movable targets.

Referring to FIG. 3A, the "U"-shaped member 117 is able to rotate with respect to the second pivot member 122 via a rotating fitting 500 positioned there between. The rotating fitting 500 is ale to temporarily unlock the "U"-shaped member 117 with respect to the second pivot member 122 in order to adjust a relative angle there between, and lock the "U"-shaped member 117 with respect to the second pivot member 122. The remaining figures depict the "U"-shaped member 117 at a linear arrangement with the pivoting member 113. FIG. 3A details the ability of the "U"-shaped member 117 to be selectively rotated in order to form a different angle of the basket 114.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A quarterback training apparatus comprising:

a plurality of tracks that are positioned on a ground surface in an array including different orientations comprising lateral, longitudinal, or diagonal;

wherein a plurality of movable targets are each slideably engaged with respect to said tracks, and which are configured for use in a football passing drill whereby an end user throws or attempts to throw a plurality of footballs at the various movable targets in order to practice different types of football passes thereto;

wherein the plurality of tracks are each of undefined lengths, and are further comprised of a pair of tubular members, which include a track support at distal ends and which engage the ground;

wherein the movable targets each include a track-engaging member that connects to and slides on the tubular members of the track;

wherein the track-engaging member includes a receptacle from which a pivoting member extends vertically therefrom; wherein the pivoting member extends vertically, and supports a basket atop thereof.

2. The quarterback training apparatus as described in claim 1 wherein the pivoting member is able to rotate 360 degrees with respect to the receptacle of the track-engaging member.

3. The quarterback training apparatus as described in claim 2 wherein the basket has a rear opening at which a flexible net is affixed thereto.

4. The quarterback training apparatus as described in claim 3 wherein the basket is of wire construction, and is secured to a "U"-shaped member that is mounted atop of the pivoting member.

5. The quarterback training apparatus as described in claim 4 wherein the flexible net is included in order for said football to be thrown through the basket, and fall down into the flexible net; wherein the flexible net is of an undefined length, and is able to collect and support a plurality of footballs that have been collected during said passing drill.

6. The quarterback training apparatus as described in claim 5 wherein the baskets have a front opening, and with which the objective is to throw the football into the front opening where the football will come to rest in the flexible net.

7. The quarterback training apparatus as described in claim 6 wherein the baskets are each further defined with a basket diameter, and that the basket diameter is able to vary amongst the several movable targets.

8. The quarterback training apparatus as described in claim 7 wherein the "U"-shaped member secures the baskets at opposing sides.

9. The quarterback training apparatus as described in claim 8 wherein the pivoting member is further defined with a first pivot member and a second pivot member that are connected to one another at a pivot point; wherein a pivot angle is selectively adjusted at the pivot point, which in turn adjusts the orientation of the basket with respect to the ground.

10. The quarterback training apparatus as described in claim 9 wherein the "U"-shaped member is able to rotate with respect to the second pivot member via a rotating fitting positioned there between; wherein the rotating fitting is ale to temporarily unlock the "U"-shaped member with respect to the second pivot member in order to adjust a relative angle there between, and lock the "U"-shaped member with respect to the second pivot member; wherein the "U"-shaped member to be selectively rotated in order to form a different angle of the basket when in use.

11. A quarterback training apparatus comprising:

a plurality of tracks that are positioned on a ground surface in an array including different orientations comprising lateral, longitudinal, or diagonal;

wherein a plurality of movable targets are each slideably engaged with respect to said tracks, and which are configured for use in a football passing drill whereby an end user throws or attempts to throw a plurality of footballs at the various movable targets in order to practice different types of football passes thereto;

wherein the plurality of tracks are each of undefined lengths, and are further comprised of a pair of tubular members, which include a track support at distal ends and which engage the ground; wherein the movable targets each include a track-engaging member that connects to and slides on the tubular members of the track;

wherein the track-engaging member includes a receptacle from which a pivoting member extends vertically therefrom; wherein the pivoting member extends vertically, and supports a basket atop thereof; wherein the pivoting member is able to rotate 360 degrees with respect to the receptacle of the track-engaging member.

12. The quarterback training apparatus as described in claim 11 wherein the basket has a rear opening at which a flexible net is affixed thereto; wherein the basket is of wire construction, and is secured to a "U"-shaped member that is mounted atop of the pivoting member.

13. The quarterback training apparatus as described in claim 12 wherein the flexible net is included in order for said football to be thrown through the basket, and fall down into the flexible net; wherein the flexible net is of an undefined length, and is able to collect and support a plurality of footballs that have been collected during said passing drill; wherein the baskets have a front opening, and with which the objective is to throw the football into the front opening where the football will come to rest in the flexible net.

14. The quarterback training apparatus as described in claim 13 wherein the baskets are each further defined with a basket diameter, and that the basket diameter is able to vary amongst the severable movable targets; wherein the "U"-shaped member secures the baskets at opposing sides.

15. The quarterback training apparatus as described in claim 14 wherein the pivoting member is further defined with a first pivot member and a second pivot member that are connected to one another at a pivot point; wherein a pivot angle is selectively adjusted at the pivot point, which in turn adjusts the orientation of the basket with respect to the ground.

16. The quarterback training apparatus as described in claim 15 wherein the "U"-shaped member is able to rotate with respect to the second pivot member via a rotating fitting positioned there between; wherein the rotating fitting is ale to temporarily unlock the "U"-shaped member with respect to the second pivot member in order to adjust a relative angle there between, and lock the "U"-shaped member with respect to the second pivot member; wherein the "U"-shaped member to be selectively rotated in order to form a different angle of the basket when in use.

* * * * *